US005757885A

United States Patent [19]

Yao et al.

[11] Patent Number: 5,757,885

[45] Date of Patent: May 26, 1998

[54] ROTARY TARGET DRIVEN BY COOLING FLUID FLOW FOR MEDICAL LINAC AND INTENSE BEAM LINAC

[75] Inventors: Chong Guo Yao, Pacheco; James S. Harroun, Concord, both of Calif.

[73] Assignee: Siemens Medical Systems, Inc., Iselin, N.J.

[21] Appl. No.: 844,490

[22] Filed: Apr. 18, 1997

[51] Int. Cl.[6] ..... H01J 35/10

[52] U.S. Cl. ..... 378/130; 378/125; 378/131

[58] Field of Search ..... 378/125, 130, 378/131

[56] References Cited

U.S. PATENT DOCUMENTS 3,576,997 5/1971 Slavin ..... 378/143

4,928,296 5/1990 Kadambi ..... 378/141

5,018,181 5/1991 Iversen et al. ..... 378/144

5,262,032 11/1993 Hartig et al. ..... 204/298.21

*Primary Examiner*—Craig E. Church

[57] ABSTRACT

A linear accelerator x-ray target assembly including an electron beam which contacts an x-ray target and generates x-rays. The target is mounted such that it can rotate freely about its axis. The target has a contoured axially outer edge. Fluid flow impinging the contoured axially outer edge of the target acts to impart rotary motion on the target. The fluid flow helps to dissipate heat from the target in two ways. Firstly, heat is transferred to a cooling fluid as the cooling fluid passes over the target. Secondly, the rotation of the target helps to dissipate heat from the target by distributing the electron beam contact point around the target instead of having the electron beam impact continuously on one spot on the target.

16 Claims, 4 Drawing Sheets

ROTARY TARGET DRIVEN BY COOLING FLUID FLOW FOR MEDICAL LINAC AND INTENSE BEAM LINAC

BACKGROUND OF THE INVENTION

The invention relates to a linear electron accelerator having a target exposed to an electron beam for the purpose of producing x-ray radiation. More particularly, the invention relates to a target assembly which provides efficient target cooling capabilities.

DESCRIPTION OF THE RELATED ART

Radiation emitting devices are generally known and used, especially in the medical field. For example, x-ray tubes generate x-ray radiation that is used in medical diagnostic equipment such as computerized tomography (CT) scanners. As another example, linear accelerators generate x-ray radiation that is used in radiation therapy equipment.

X-ray tubes for medical diagnosis generate radiation inside a vacuum tube. Within the vacuum tube, a cathode creates a beam of electrons, in the kilo volt range, which contacts an anode at a relatively close distance. The electrons impinging on the anode generate the x-rays and exit the tube.

Linear accelerators for radiation therapy generate x-rays in conjunction with an external target instead of an anode. The intensity of x-rays required for radiation therapy is beyond the capability of x-ray tubes. The linear accelerator generates a high energy electron beam, in the mega volt range, which is impacted with a target. The impact of the electron beam with the target generates the x-rays. Additional equipment is used to focus the x-rays for medical radiation treatment.

Linear accelerators generate high energy electron beams by subjecting electrons to a series of electrical fields that act to accelerate the electrons along a path. A portion of the energy of the accelerated electrons is transformed into x-radiation or x-rays as the electrons rapidly lose their energy upon colliding with an appropriate metal target. In general, more intense x-rays are generated by accelerating the electrons to a higher speed before impact with an x-ray generating target.

One consequence of x-ray generation is that when the electron beam contacts the anode of the x-ray tube or the target of the linear accelerator, a substantial amount of heat is generated. The heat is generated because only a small portion of the electron beam's energy is converted into x-rays while the majority of the electron beam's energy is transferred to the anode or target in the form of thermal energy. Because the anode or target is absorbing intense heat, a mechanism for cooling the anode or target is typically utilized.

In x-ray tube technology, cooling an anode by applying a liquid and mechanically rotating the anode is known. Typical liquid cooled rotating anodes are described in U.S. Pat. No. 5,018,181 to Iversen et al and U.S. Pat. No. 4,928,296 to Kadambi. Both of these anodes are partially hollow so that a heat transfer fluid can be circulated inside the anode to dissipate heat. The anodes are mechanically rotated so that the energy beam does not contact the anode constantly at the same spot. The anodes are connected to motor-driven shafts and drive mechanisms which provide active rotation to the anodes.

Although these techniques work well for dissipating heat from x-ray tubes, they do have drawbacks. For example, the rotation mechanism of the anode requires additional equipment that increases the cost of the x-ray tube. Additionally, the heat-intensive environment can quickly erode necessary rotational bearings and mechanical parts, rendering the x-ray tube less reliable.

In linear accelerator x-ray technology different target cooling techniques have been used. Heat transfer is provided by passing a cooling liquid such as water over a fixed target. For a fixed cooling water velocity and inlet temperature, there is a limit to the rate at which heat can be dissipated from the target. If the rate of heat dissipation is not sufficient, the target temperature may exceed the melting point of the target material. If this happens, the cooling water erodes the target material, reducing the efficiency of the x-ray conversion process. This leads to lower x-ray energy and output from the same electron current.

Hollow targets similar to the hollow anodes in x-ray tube technology are not used with linear accelerators. In linear accelerator technology the target is typically a single monolithic material, usually in the shape of a disk or square.

Another target cooling technique in linear accelerator x-ray technology includes utilizing a system of electromagnetic coils located around the linear accelerator to steer the impact point of the high energy electron beam upon the target. With this system, the impact point is constantly in motion such that the beam does not impact on any one area of the target for an extended period of time. While this technique is effective, using electromagnetic coils to steer the high electron beam requires additional active components including electromagnetic coils, power supplies, and controls. The additional components required to steer the electron beam increase the cost and reduce the reliability of the equipment.

What is needed is a target assembly and a method which provide improved heat dissipation from the target of a linear accelerator x-ray system.

SUMMARY OF THE INVENTION

A linear accelerator x-ray target assembly including an electron beam which contacts an x-ray target and generates x-rays. The target is mounted such that it can rotate freely about its axis. The target has a contoured axially outer edge. Fluid flow impinging the contoured axially outer edge of the target imparts passive rotary motion on the target.

In the preferred embodiment, the target is disk shaped and its entire axially outer edge is notched. The target is mounted to a target holder to rotate freely about an axis of rotation. The target holder has a channel that directs cooling fluid flow to impinge on the notched axially outer edge of the target. Cooling fluid flowing through the target holder channel imparts passive rotary motion on the target as the fluid impacts on the notched edge of the target. The cooling fluid flowing over the target acts to remove the heat from the target that is generated by a high energy electron beam contacting the target. The rotary motion imparted by the flowing cooling fluid distributes the electron beam of the linear accelerator around the target thereby reducing the heat flux on any one portion of the target.

The method of dissipating thermal energy from an x-ray target includes mounting the target to freely rotate at a position within the separate paths of the radiation beam and the cooling fluid. Preferably, a target holding assembly is utilized.

DETAILED DESCRIPTION

Figure 1:
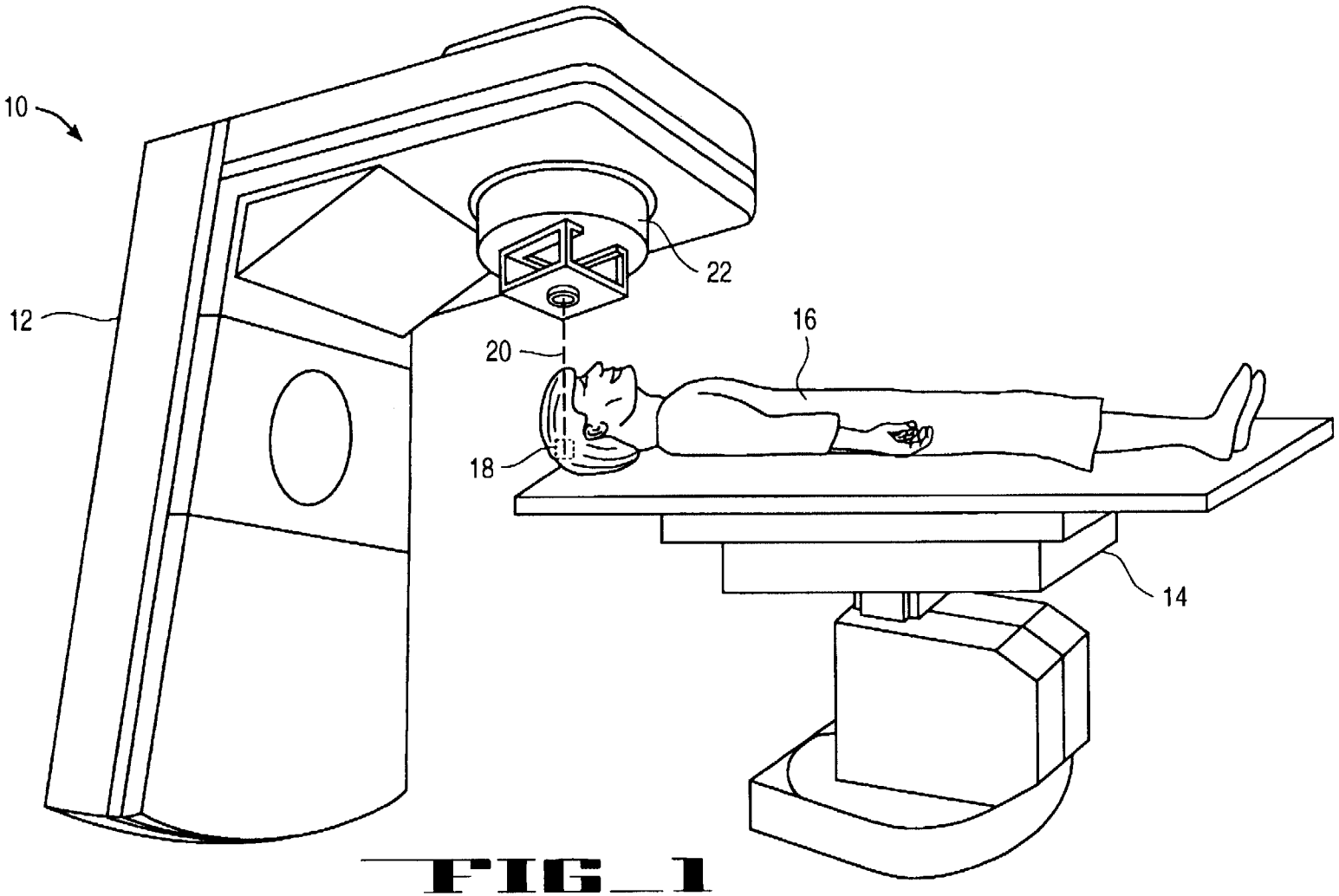
FIG. 1 (PRIOR ART)
FIG. 1 is a perspective view of a prior art medical radiation therapy system.

FIG. 1 is a depiction of a system used to deliver x-ray radiation for medical treatment. The radiation system 10 includes a gantry 12 and a patient table 14. Inside the gantry, a linear accelerator is used to generate x-rays for treatment of a patient 16. In this system, the gantry and the patient table can be manipulated so that the x-ray treatment is delivered to the appropriate location 18. The x-rays 20 generated by the linear accelerator are emitted from the gantry through the treatment head 22.

Figure 2:
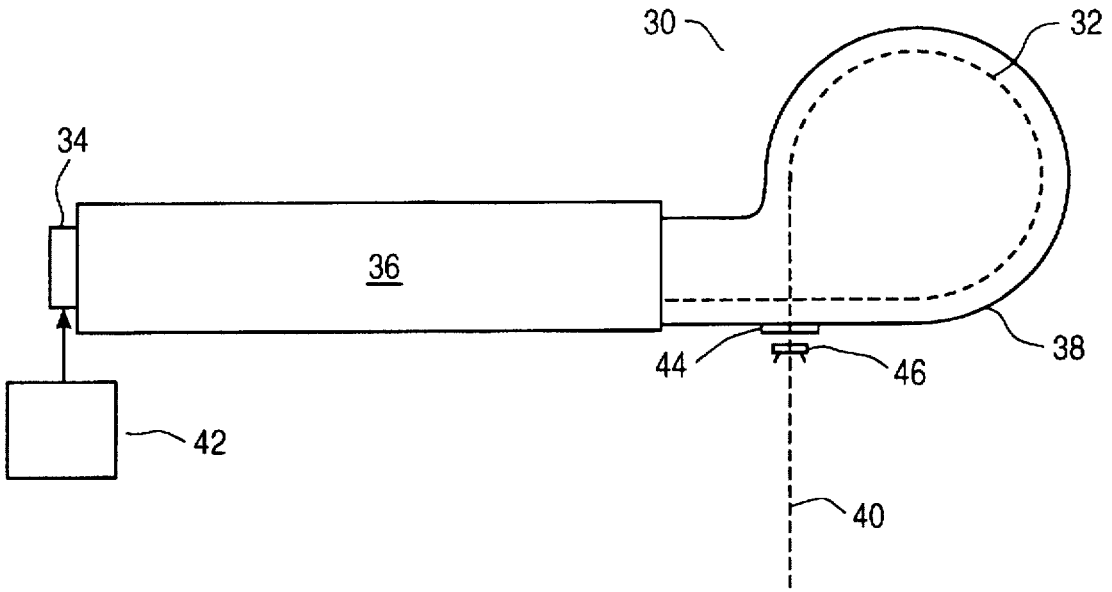
FIG 2 (PRIOR ART)
FIG. 2 is a diagram of a prior art linear accelerator x-ray device.

Referring now to FIG. 2, a conventional linear accelerator ("linac") 30 may be used to generate the x-ray radiation that is emitted from the radiation system of FIG. 1. The energy level of the electron beam is determined by a controller 42 that activates an electron gun 34 of the linac. The electrons from the electron gun are accelerated along a waveguide 36 using known energy-transfer techniques.

The electron beam 32 from the waveguide of the linac enters a conventional guide magnet 38, which bends the electron beam by approximately 270°. The electron beam then exits through a window 44 that is transparent to the beam, but preserves the vacuum condition within the linac.

Along the axis 40 of the exiting electron beam is a metal target 46. The electron beam impacts the target and x-ray radiation is generated. The x-rays then travel along the axis 40 of the electron beam. The x-ray target is housed in an assembly which is not shown in this figure.

Typically, a collimator is positioned downstream along the x-ray beam path. The collimator functions to limit the angular spread of the radiation beam. For example, blocks of radiation-attenuating material may be used to define a radiation field that passes through the collimator to a patient.

The target-cooling techniques to be described below provide a way to dissipate heat from a linear accelerator x-ray target such that the target can sustain a higher level of electron beam energy. Heat dissipation is achieved through passive rotation of the target by a cooling fluid contacting the contoured outer edge of the target. As will be described more fully below, the fluid flow helps to dissipate heat from the target in two ways. Firstly, heat is transferred to the cooling fluid as the cooling fluid passes over the target. Secondly, the rotating target helps to dissipate heat from the target by distributing the electron beam contact point around the target instead of having the electron beam impact continuously on one spot on the target.

Figure 3:
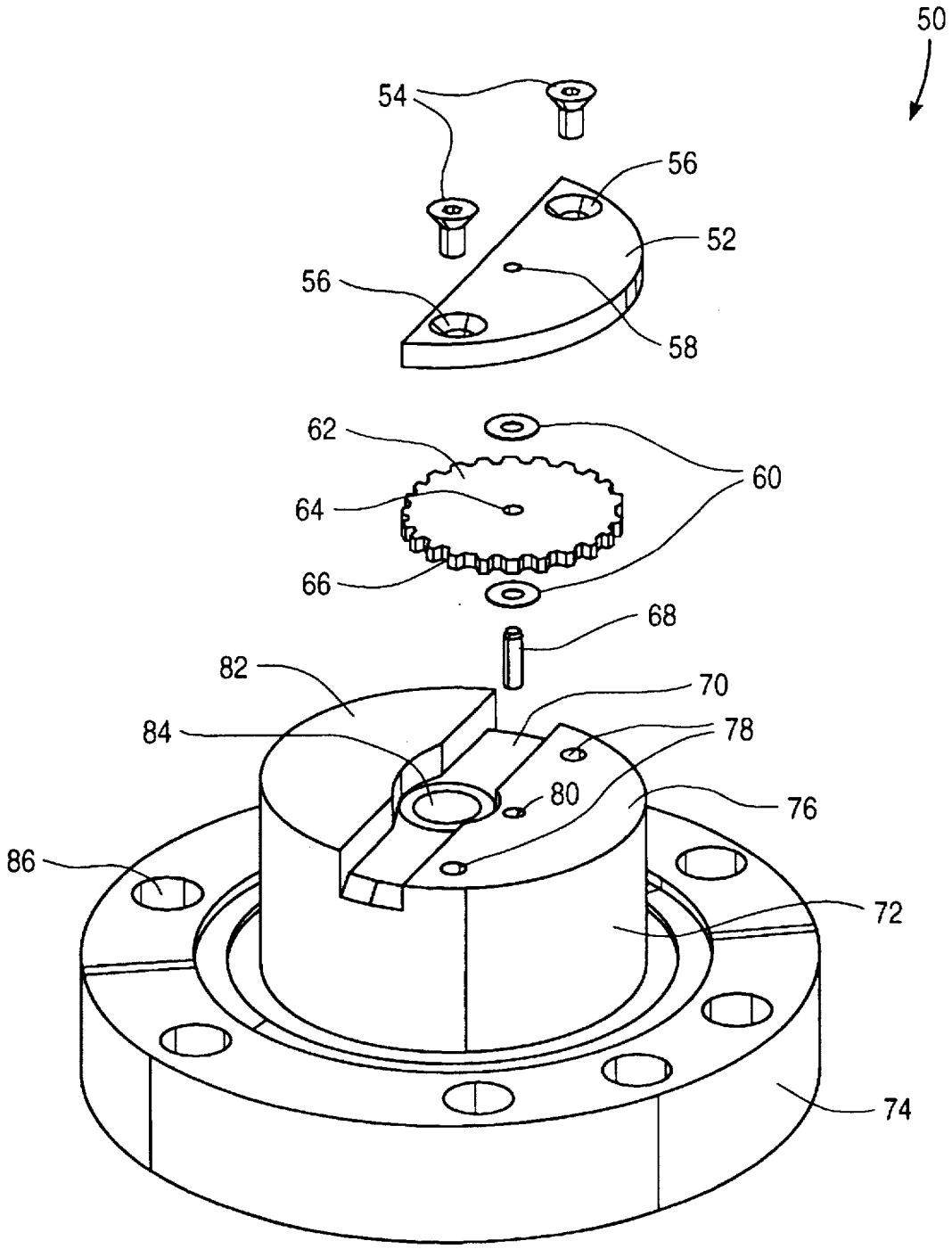
FIG. 3 is a perspective view of the target assembly.

In the preferred embodiment of the invention depicted in FIG. 3, the invention includes a target and a target holding assembly. The target 62 in the preferred embodiment is a disk-shaped piece of metal. The metal is a type that produces x-rays when impacted by a high energy electron beam. In this embodiment the metal is tungsten, Mil-T-21014D Class 3, no iron, Kulite Alloy #1801. The target has a through hole at its center of axis 64. The target also has notches 66 (or "teeth") machined into its entire axially outer edge, so that the target includes the notches about its entire circumferential surface.

The target holding assembly 50 of the invention includes a target holder 72, a target cover 52, and an attachment flange 74. The target holder 72 is a cylindrical piece of metal which has a hole 84 that goes through the axis of the cylinder. The target holder has a channel 70 that runs through the top end of the cylinder. The channel crosses the center and the complete diameter of the cylindrical holder, creating two platforms 76 and 82. Platform 76 is slightly lower than 82. On the lower platform 76, two holes 78 are provided for attaching the target cover to the target holder. As well, a hole 80 is provided for attaching a target rotation pin 68 to the target holder.

Figure 5:
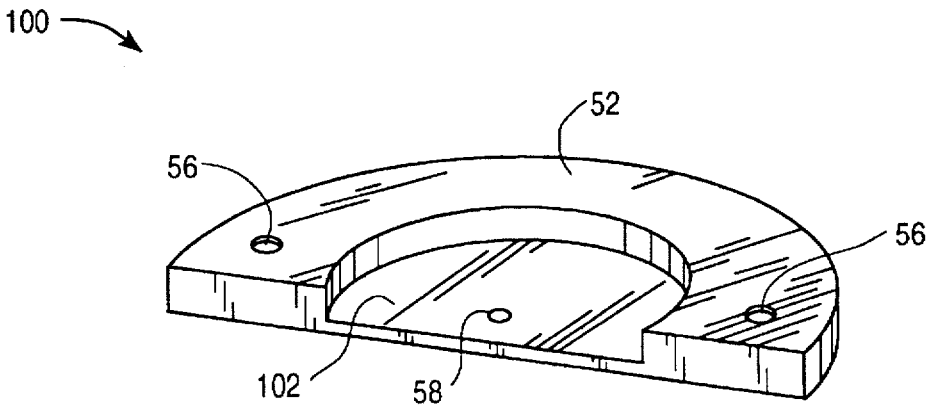
FIG. 5 is a perspective view of the underside of the target cover.

The target cover 52 is a thin piece of metal shaped the same as the lower platform 76. The target cover has two through holes 56 which match up with the holes 78 on the target holder. The target cover also has a through hole 58 for attaching the target rotation pin to the target cover. As depicted in FIG. 5, the underside of the target cover 100 has a cavity 102 bore into it such that the cover can fit over the target without contacting the target.

The attachment flange 74 is a metal ring which fits over the lower end of the target holder. The flange has a series of through holes 86 which are used to attach the entire target holding assembly to the necessary linear accelerator equipment.

In addition to the main parts, the preferred embodiment also includes attachment screws 54, washers 60, and a target rotation pin 68. The target holding device and the target are attached such that the target can rotate freely about its center of axis. The target is attached to the target holding device by the target rotation pin 68 which is inserted through the center of axis of the target 64. Washers 60 are placed over the target rotation pin on each side of the target. One end of the target rotation pin is placed in pin hole 80 of the target holder. The other end of the target rotation pin is placed in through hole 58 of the target cover. The target cover is fit over the target so that the cavity in the target cover surrounds, but does not touch, the target. The through holes 56 of the target cover are aligned with the holes 78 in the target holder and the attachment screws 54 are placed into the holes to secure the target in between the target cover and the target holder. The target holding assembly allows the target to rotate freely around its axis of rotation.

The target is positioned in the target holder such that one portion of the target is in the target holder channel and the other portion of the target is in between the target holder and the cover. As shown in the plan view 90 of FIG. 4, the target is also positioned so that the high energy electron beam 96 strikes the target near the outer edge of the exposed portion of the target which lies in the channel of the target holder. The electron beam comes from a linear accelerator that is located above the target assembly and the beam's trajectory is fixed with respect to the target assembly.

Figure 4:
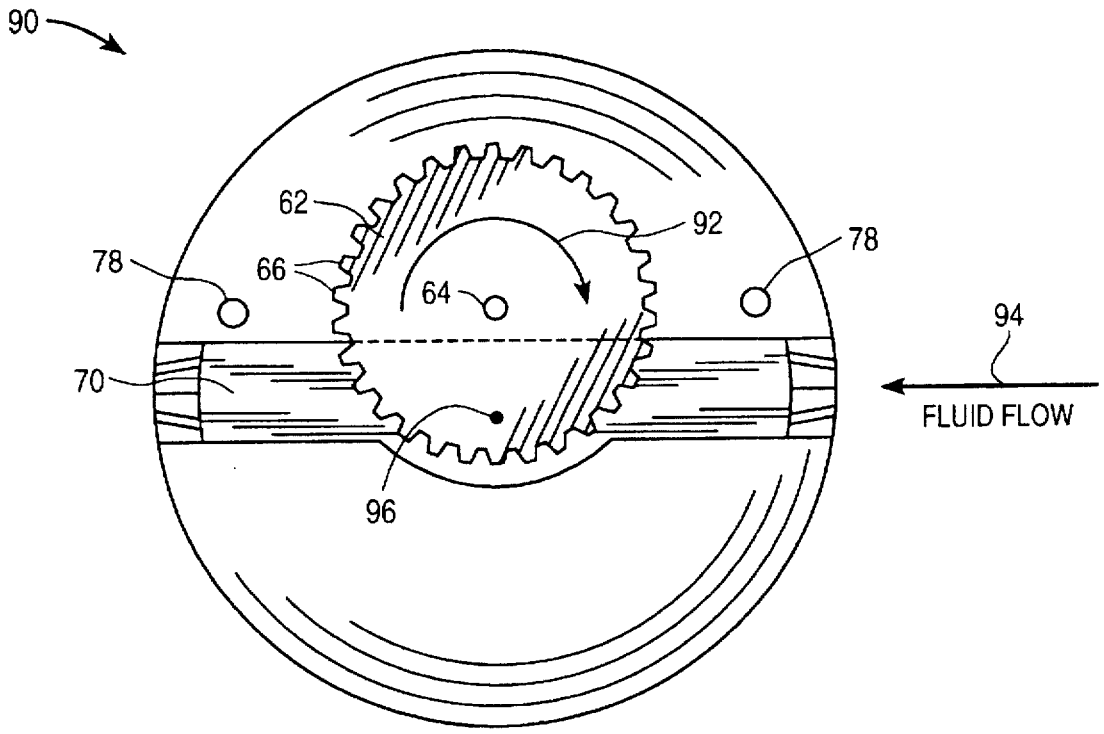
FIG. 4 is a plan view of the target assembly which depicts fluid flow and target rotation.

The target holder and the target assembly dissipate heat from the target with the help of a cooling fluid. In this case, water is used as the cooling fluid but other fluids such as gases or other liquids could be used. As depicted in FIG. 4, water is circulated, utilizing conventional fluid pumping and plumbing techniques, through the channel 70 in the target holder. The water flows in direct contact with the target. Heat generated from the electron beam contacting the target is transferred from the target to the flowing water. As a result, the target is cooled. The exiting heated water is then cooled by an ancillary heat exchanger or other cooling device.

In addition to the water's cooling effect, forces are created between the flowing water 94 and the notched outer edge 66 of the target. The forces are created when the water impacts the notches on the outer edge of the target. The notches on the outer edge of the target act essentially as paddles creating forces in the direction of the flowing water. The forces in the direction of the flowing water cause the target to rotate 92 about its axis without the use of motors or other mechanical drives.

Since the target is rotating and the electron beam contact point is fixed, the electron beam contact with the target is distributed in a circular pattern around the target. The circular distribution of the beam contact point acts to spread the heat generated from the beam around the target, thereby reducing the heat flux at any one point on the target. The rotation also gives any localized region on the target more time to dissipate heat before falling under the beam again. As well, during the rotation of the target the cooling water is continuously flowing over the rotating target, transferring heat from the target to the cooling water.

The rotation of the beam is passive in that it is achieved with no moving parts and no active drive mechanism. Contouring the outer edge of the target provides the needed forces as the water passes over the target. The forces are sufficient to rotate the target, which is attached to the target holder such that it can rotate freely.

Test results have shown that passively rotating the target is effective in dissipating heat and preserving the life of the target. In tests measuring x-ray output energy versus hours of target use, the rotating target performed for over five times longer than the stationary target. The stationary target had a hole burned completely through it after approximately 40 hours of operation under test conditions. In contrast, after over 200 hours of operation under the same conditions, the rotating target showed no wear and still performed effectively. The rotating target did develop a ring around the target at the electron beam contact point, but when measured with a height gauge, the ring turned out to be material build-up on the target (approximately 0.003 inches thick on both sides) rather than material eroded from the target.

While the invention has been particularly shown and described with reference to a preferred embodiment, various changes in form and details may be made without departing from the spirit and scope of the invention. For example, the target does not necessarily have to be disk shaped to be able to serve its function and the target does not need to have a notched outer surface but could have another configuration which creates the necessary rotational force. If the target were triangle shaped or star shaped and similarly fixed around an axis of rotation, the target would rotate upon similar contact with a cooling fluid. The notched surface could also be replaced by a sufficiently roughed surface or a series of curved paddles.

The target holding assembly does not need to be cylindrical and could instead be, for example, square. The target holding assembly does not have to be metal but it must have a high melting point. The target cover does not have to be shaped as disclosed, and may not be necessary for the invention to function. The attachment flange can be substituted for another attachment means. For instance, attachment feet could be permanently fixed onto the target holder cylinder 72.

As stated above, the cooling fluid could be a different fluid material including liquids other than water, as well as gases, including, for example, air or nitrogen. In addition, contacting the cooling fluid with the target does not have to be accomplished utilizing the channel in the target holder as identified in the preferred embodiment. The cooling fluid could be delivered in a tube which emits a stream of cooling fluid directly onto the target.

What is claimed is:

1. An x-ray target assembly comprising:

a target mounted to rotate about an axis of rotation, said target being formed of a material to generate an x-ray output beam when exposed to an impinging beam, said target being configured to provide rotational motion when impinged by fluid flow, and means for rotating said target by directing a fluid flow to impinge said target.

2. The x-ray target assembly of claim 1 wherein said target is positioned relative to a linear accelerator such that said impinging beam is an electron beam.

3. The x-ray target assembly of claim 1 wherein said target is disk shaped.

4. The x-ray target assembly of claim 3 wherein said disk shaped target includes an axially outer edge, said axially outer edge having notches.

5. The x-ray target assembly of claim 1 wherein said target is attached to a target holding device, said target holding device including a channel that directs fluid flow to impinge said target, thereby imparting rotary motion to said target.

6. A method for dissipating thermal energy from an x-ray target comprising the steps of:

mounting said target to rotate within a path of an impinging beam, said target being formed of a material to generate x-rays in response to said impinging radiation beam, said target having a rotational axis and having a contoured axially outer edge; and passing a cooling medium over said contoured axially outer edge such that said cooling medium imparts rotary motion upon said target.

7. The method of claim 6 further comprising the steps of:

providing a target holding assembly, wherein said target holding assembly has a channel running through a portion of said target holding assembly, and directing said cooling medium to pass through said channel such that said cooling medium imparts rotary motion upon said target.

8. The method of claim 6 wherein said step of passing a cooling medium over said contoured axially outer edge is a step of directing water at said contoured axially outer edge.

9. The method of claim 6 wherein said step of mounting said target includes providing a disk-shaped target for which said contoured axially outer edge is a circumferential surface.

10. The method of claim 6 wherein said step of mounting said target includes forming notches on said axially outer edge.

11. The method of claim 6 wherein said step of mounting said target includes connecting said target to a linear accelerator such that said impinging radiation beam is an electron beam.

12. The method of claim 6 wherein said step of mounting said target includes forming said target of tungsten.

13. A system for forming x-ray radiation comprising:

a source of an electron beam, said source having an output beam path;

a disk shaped x-ray target supported within said output beam path, said target being freely rotatable about an axis of rotation, said target having an axially outer edge configured to promote target rotation in response to impingement by cooling fluid; and means for directing a flow of said cooling fluid to impinge said axially outer edge of said target.

14. The system of claim 13 wherein said means for directing a flow of said cooling fluid includes a target holding devise having a channel, wherein said channel runs through one end of said target holding device and directs said cooling fluid flow such that said cooling fluid flows over said axially outer edge of said target.

15. The system of claim 13 wherein said source of said electron beam is a linear accelerator.

16. The system of claim 13 wherein said contoured axially outer edge of said target is a notched outer edge.

* * * * *